US007089920B2

(12) United States Patent
Nakoji et al.

(10) Patent No.: US 7,089,920 B2
(45) Date of Patent: Aug. 15, 2006

(54) DIAGNOSTIC APPARATUS FOR EVAPORATIVE EMISSION CONTROL SYSTEM

(75) Inventors: Yasushi Nakoji, Tokyo (JP); Daisuke Takahashi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/200,094

(22) Filed: Aug. 10, 2005
(Under 37 CFR 1.47)

(65) Prior Publication Data

US 2006/0032297 A1 Feb. 16, 2006

(30) Foreign Application Priority Data

Aug. 11, 2004 (JP) ..... 2004-234648

(51) Int. Cl.
*F02M 37/04* (2006.01)

(52) U.S. Cl. ..... 123/520; 123/198 D

(58) Field of Classification Search ..... 123/520, 123/521, 519, 518, 516, 198 D
See application file for complete search history.

(56) References Cited

U.S. PATENT DOCUMENTS 5,230,319 A * 7/1993 Otsuka et al. ..... 123/520
5,758,628 A * 6/1998 Wada ..... 123/520
5,765,540 A * 6/1998 Ishii et al. ..... 123/520
6,289,880 B1 9/2001 Yamaguchi et al. ..... 123/520
6,405,718 B1 * 6/2002 Yoshioka et al. ..... 123/520
6,782,874 B1 * 8/2004 Matsumoto ..... 123/520
2001/0032625 A1 * 10/2001 Fabre ..... 123/520
2001/0032626 A1 * 10/2001 Fabre ..... 123/520
2001/0054415 A1 * 12/2001 Hanai et al. ..... 123/520
2002/0112703 A1 * 8/2002 Fujimoto et al. ..... 123/520
2002/0179066 A1 * 12/2002 Matsumoto et al. ..... 123/520
2005/0044940 A1 3/2005 Nakoji
2005/0044941 A1 3/2005 Nakoji
2005/0241377 A1 11/2005 Takahashi

FOREIGN PATENT DOCUMENTS

JP 2001-041116 2/2001

* cited by examiner

*Primary Examiner*—Carl S. Miller
(74) *Attorney, Agent, or Firm*—Smith, Gambrell & Russell, LLP

(57) ABSTRACT

In a diagnostic apparatus for an evaporative emission control system having a fuel tank is hermetically sealed under negative pressure on the basis of target inner pressure, and leak of the evaporative emission control system is judged when a diagnosis value based on a pressure variation amount after the hermetical sealing under at least negative pressure is larger than a judgment value, ECU estimates an evaporated fuel generated amount on the basis of a tank inner pressure value at the start time of a diagnosis. When the evaporated fuel generated amount thus estimated is large, target inner pressure Pteb is set to a high value, and when the evaporated fuel generated amount thus estimated is small, the target inner pressure Pteb is set to a low value.

20 Claims, 8 Drawing Sheets

DIAGNOSTIC APPARATUS FOR EVAPORATIVE EMISSION CONTROL SYSTEM

CROSS REFERENCE TO RELATED APPLICATIONS

The disclosure of Japanese Application No. 2004-234648 filed on Aug. 11, 2004 including the specification, drawings and abstract is incorporated herein by reference in its entirety.

BACKGROUND OF THE INVENTION

1. Field of the Invention

The present invention relates to a diagnosing device for an evaporative emission control system, and particularly to a leak diagnosis of an evaporative emission control system containing a fuel tank.

2. Description of the Related Art

There is known an internal combustion engine that is equipped with an evaporative emission control system to prevent fuel evaporated in a fuel tank from being discharged to the atmosphere. In this system, evaporated fuel (evaporation gas) generated in the fuel tank is temporarily adsorbed to absorbent filled in a canister, and also the evaporated fuel thus adsorbed is discharged to an intake system of the internal combustion engine through a purge passage under a predetermined driving condition. However, when a part of this system is damaged for some reason, the evaporated fuel can be discharged into the atmosphere. In order to prevent such a situation, a leak diagnosis for judging the presence or absence of leakage of the evaporative emission control system is carried out (for example, see JP-A-2001-41116).

According to the leak diagnosis, a purge control valve (purge control solenoid valve) is fully closed, and then a canister closing valve (drain valve) is fully closed, whereby a hermetically sealed purge passage which is hermetically sealed under ambient pressure is formed and a pressure variation amount P1 caused by occurrence of fuel evaporated gas under positive pressure is measured. Thereafter, the purge control valve is opened to introduce intake pipe negative pressure into the fuel tank. When the inner pressure of the fuel tank reaches predetermined target inner pressure, the purge control valve is closed again, whereby the hermetically-sealed purge passage which is hermetically sealed under the predetermined negative pressure is formed, and a pressure variation amount P2 caused by occurrence of the evaporated fuel under the negative pressure is measured. The presence or absence of leak from the evaporative emission control system is judged on the basis of the relationship between the pressure variation amounts P1 and P2 thus measured.

However, according to the diagnosis method of hermetically sealing the evaporative emission control system under negative pressure on the basis of target inner pressure and judging the presence or absence of leak by using the pressure variation amount after the hermetical sealing under negative pressure, a negative pressure introducing time needed to set the inner pressure of the evaporative emission control system to the target inner pressure is longer as the generated amount of the evaporated fuel in the fuel tank is larger, so that the diagnosis time is lengthened.

Furthermore, in order to achieve a diagnosis result with high precision, it is needed to measure the pressure variation amount under a stable pressure state. However, the pressure state after the hermetical sealing under negative pressure is generally susceptible to introduction of negative pressure, and thus it trends to disrupt the stability as the negative pressure introducing time is longer, so that it is difficult to achieve a diagnosis result with high precision when a large amount of evaporated fuel occurs.

SUMMARY OF THE INVENTION

The present invention has been implemented in view of the foregoing situation, and has an object to provide a diagnosing device for an evaporative emission control system that can make a leak diagnosis with high precision without lengthening a diagnosis time even when a larger amount of evaporated fuel occurs.

In order to attain the above object, according to the present invention, there is provided a diagnosing device for an evaporative emission control system in which an evaporative emission control system containing a fuel tank is hermetically sealed under negative pressure on the basis of target inner pressure, and leak of the evaporative emission control system is judged when a diagnosis value based on a pressure variation amount after the hermetical sealing under at least negative pressure is larger than a judgment value, characterized by comprising an evaporated fuel generated amount estimating unit for estimating an generated amount of evaporated fuel in the fuel tank, and a target inner pressure setting unit for variably setting the target inner pressure on the basis of at least the generated amount of the evaporated fuel estimated by the evaporated fuel generated amount estimating unit, wherein the target inner pressure setting unit sets the target inner pressure to a higher value as the generated amount of the evaporated fuel is larger.

According to the diagnosing device of the evaporative emission control system of this invention, even when a larger amount of the evaporated fuel generated, a leak diagnosis can be carried out with high precision without lengthening a diagnosis time.

DETAILED DESCRIPTION OF THE PREFERRED EMBODIMENTS

A preferred embodiment according to the present invention will be described hereunder with reference to the accompanying drawings.

Figure 1:
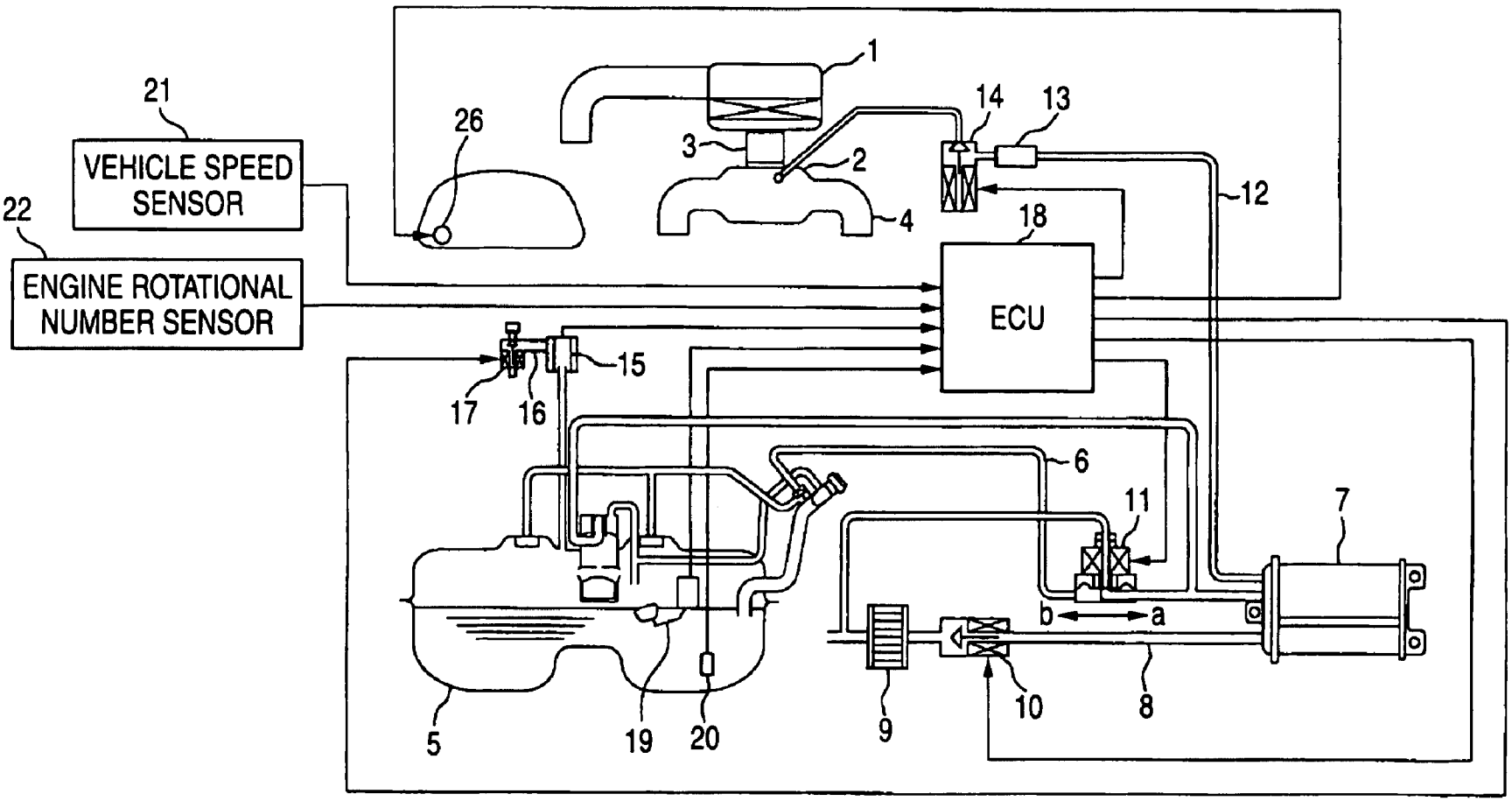
FIG. 1 is a diagram showing the construction of an evaporative emission control system.
Figure 2:
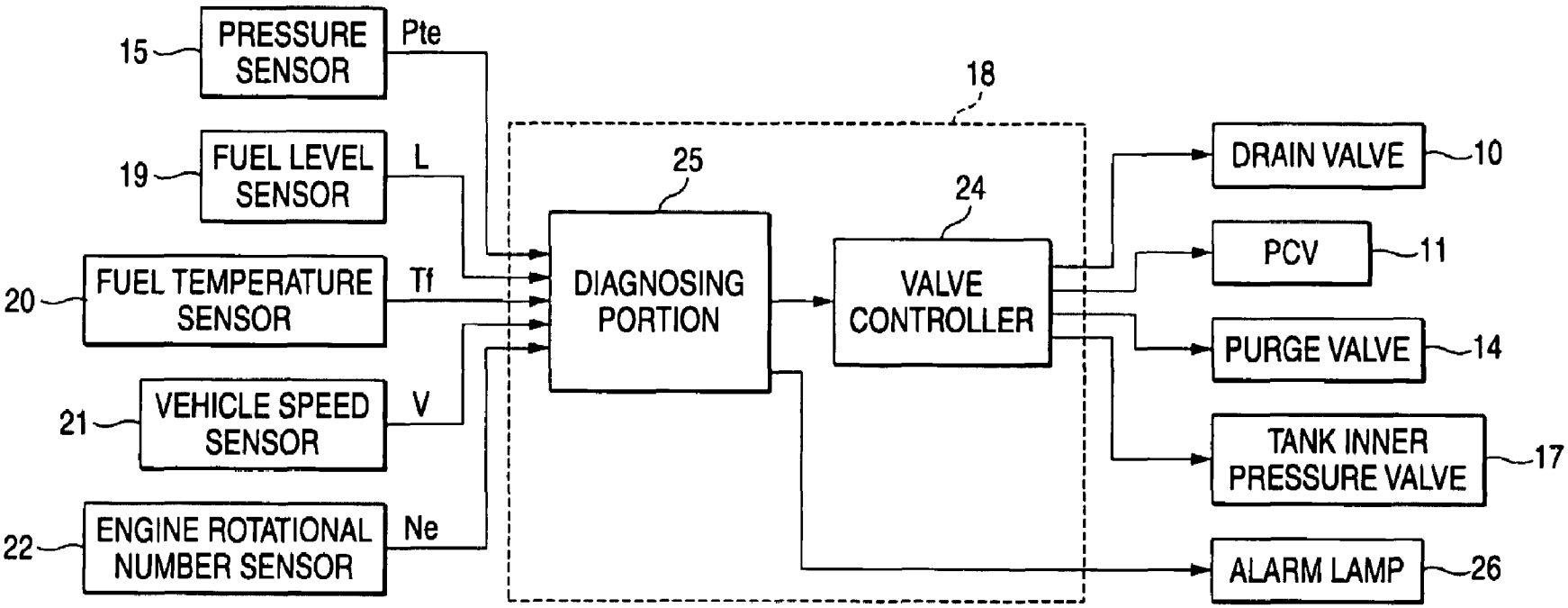
FIG. 2 is a functional block diagram showing ECU.
Figure 3:
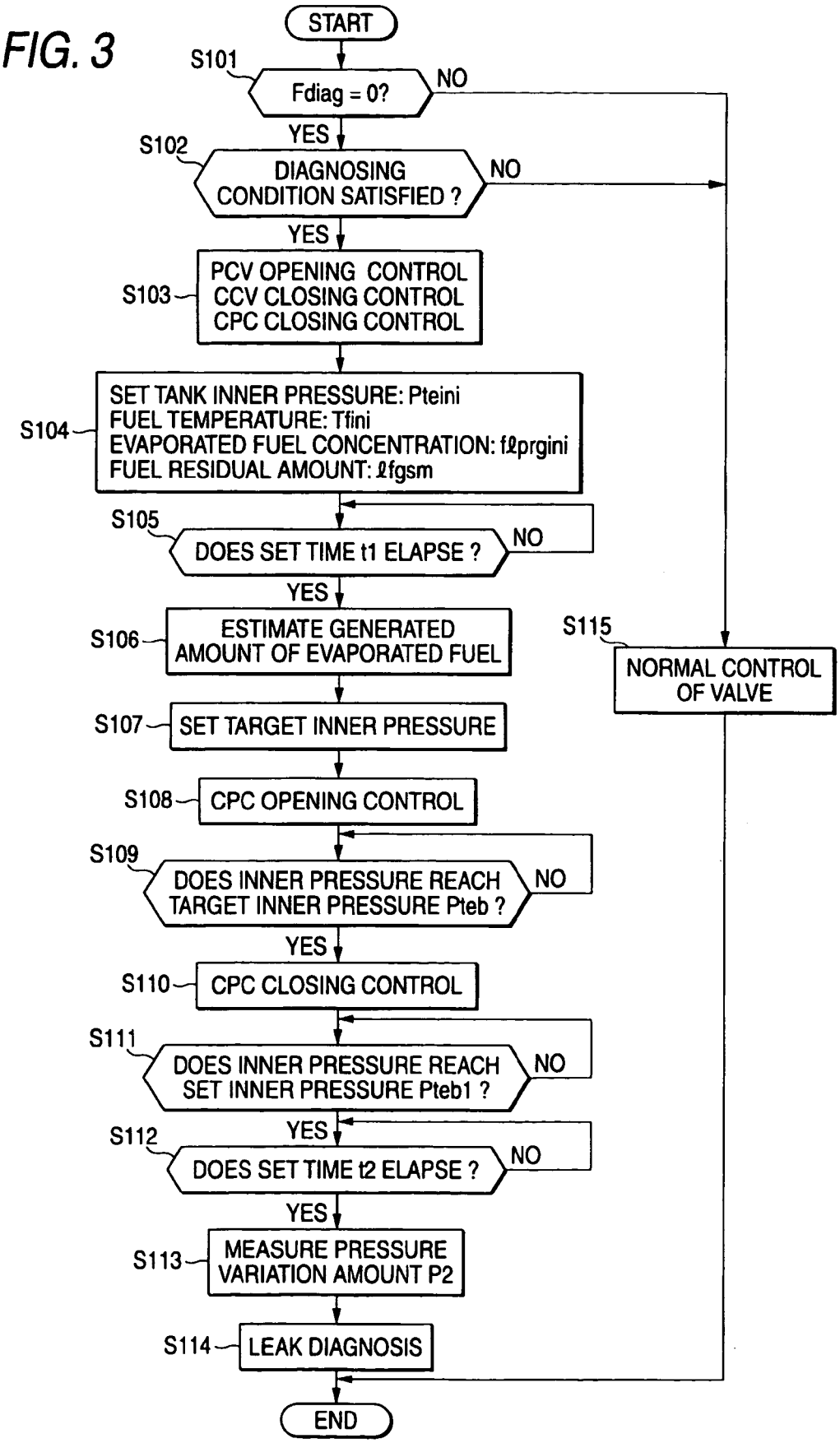
FIG. 3 is a flowchart showing a leak diagnosis routine.
Figure 4:
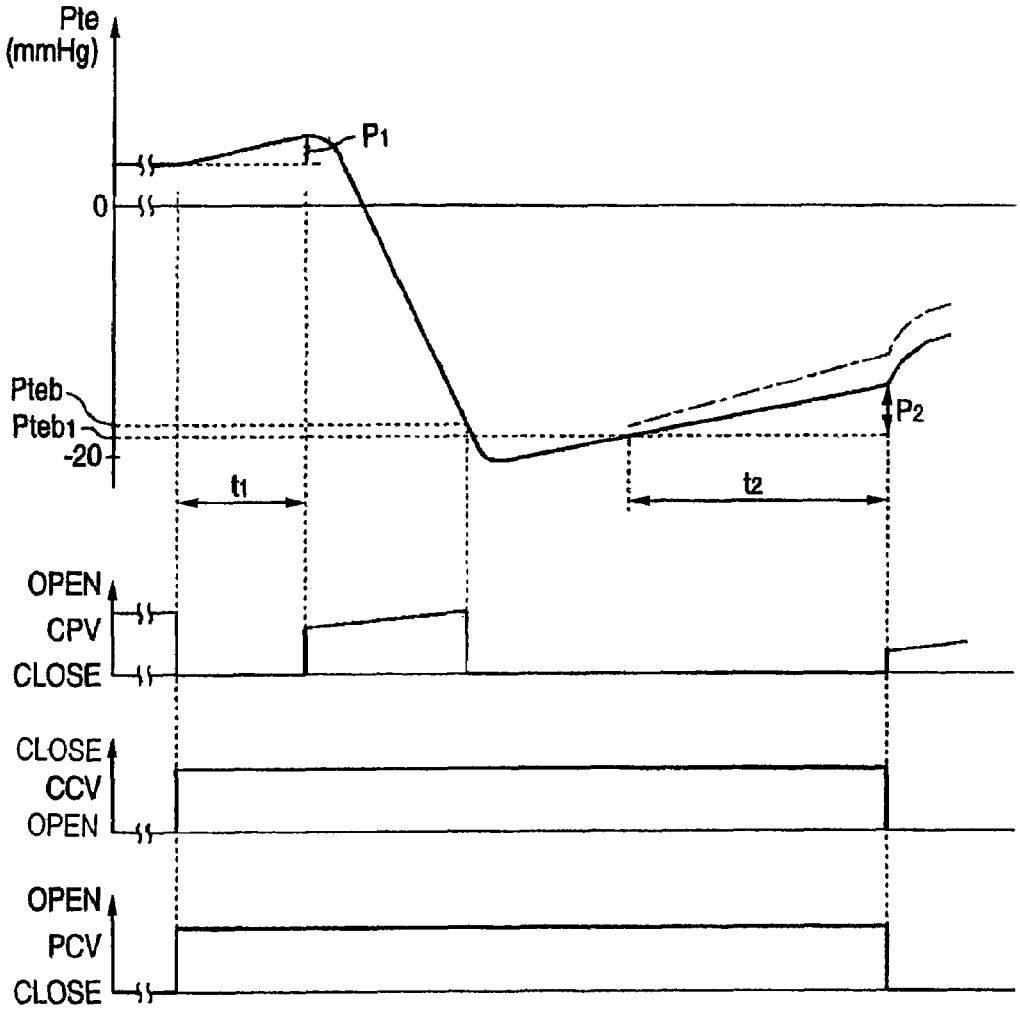
FIG. 4 is a timing chart of a leak diagnosis when an generated amount of evaporated fuel is small.
Figure 5:
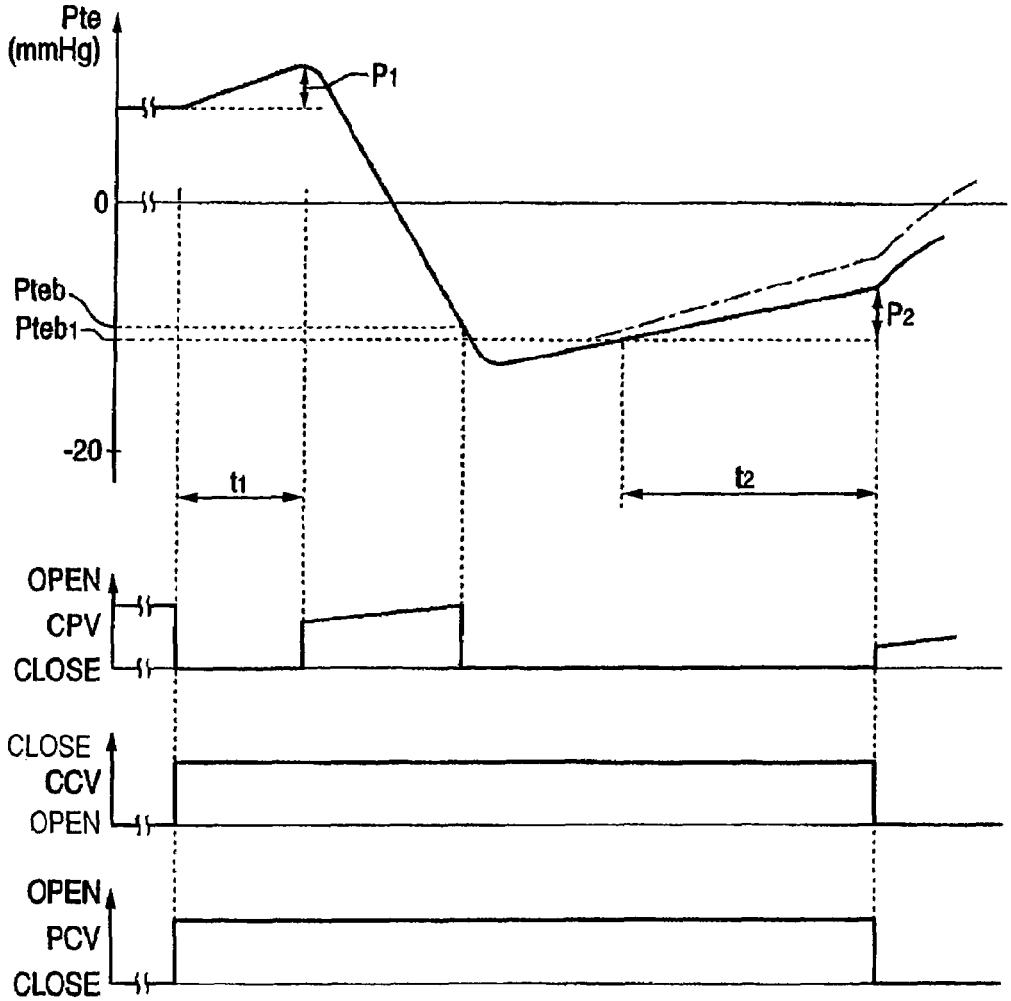
FIG. 5 is a timing chart of the leak diagnosis when the generated amount of evaporated fuel is large.
Figure 6:
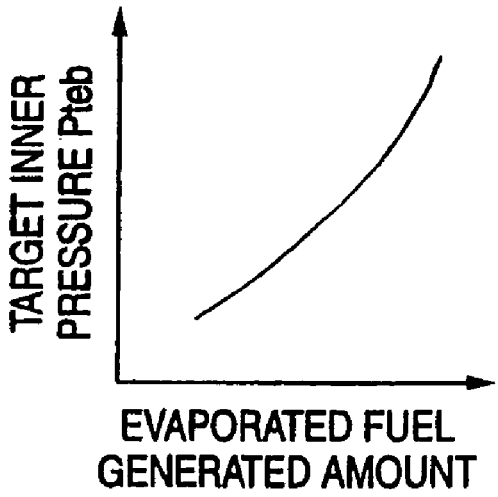
FIG. 6 is a map showing the relationship between the generated amount of the evaporated fuel and the target inner pressure.
Figure 7:
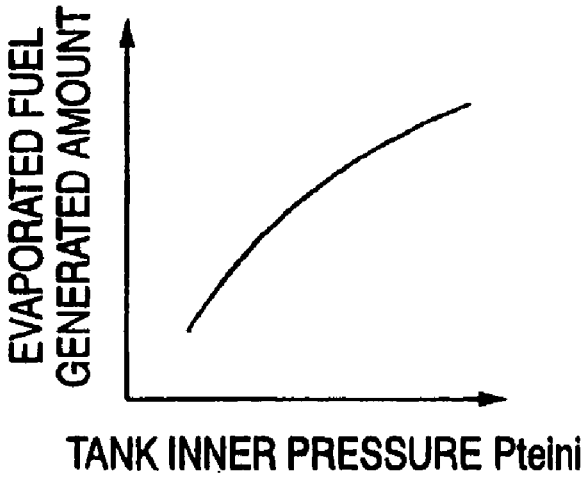
FIG. 7 is a map showing the relationship between the tank inner pressure and the generated amount of the evaporated fuel.
Figure 8:
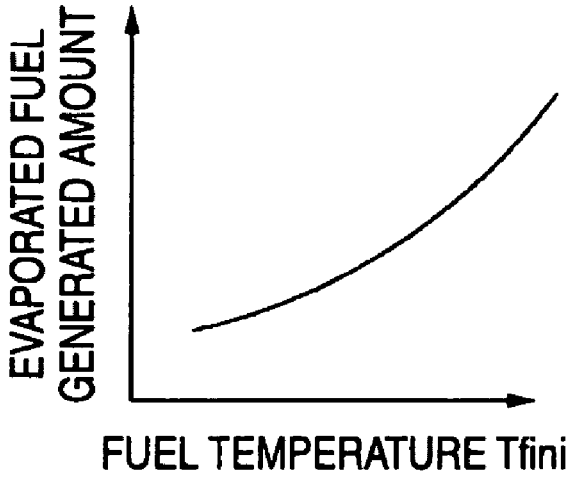
FIG. 8 is a map showing the relationship between the fuel temperature and the generated amount of the evaporated fuel.
Figure 9:
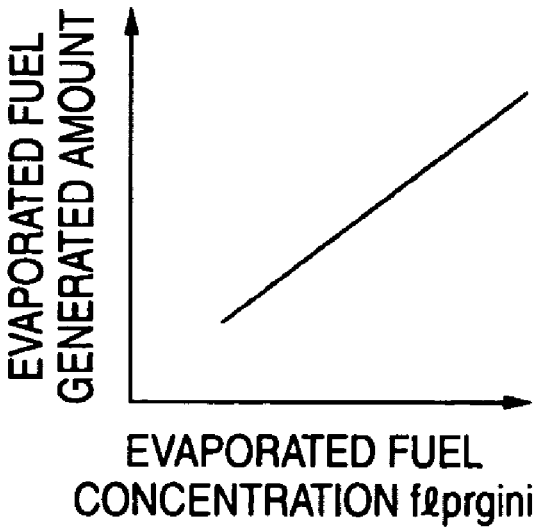
FIG. 9 is a map showing the relationship between the concentration of the evaporated fuel and the generated amount of the evaporated fuel.
Figure 10:
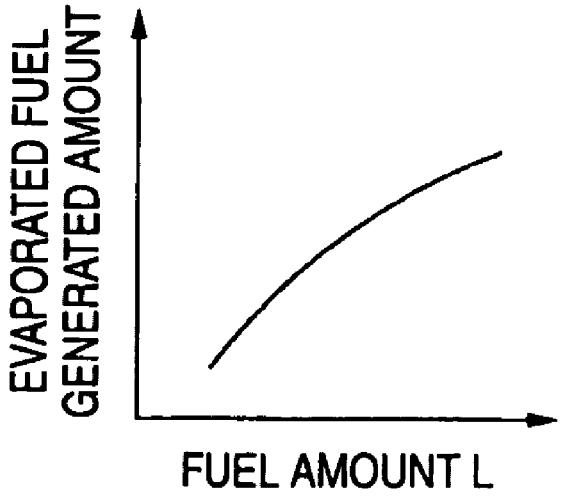
FIG. 10 is a map showing the relationship between the fuel amount and the generated amount of the evaporated fuel.
Figure 11:
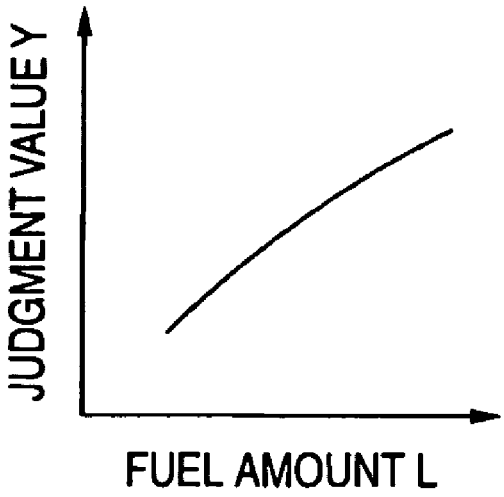
FIG. 11 is a map showing the relationship between the fuel amount and the judgment value.

FIG. 1 is a diagram showing the construction of an evaporative emission control system, FIG. 2 is a functional block diagram of ECU, FIG. 3 is a flowchart showing a leak diagnosis routine, FIG. 4 is a timing chart of a leak diagnosis when an generated amount of evaporated fuel is small, FIG. 5 is a timing chart of the leak diagnosis when the generated amount of evaporated fuel is large, FIG. 6 is a map showing the relationship between the generated amount of the evaporated fuel and the target inner pressure, FIG. 7 is a map showing the relationship between the tank inner pressure and the generated amount of the evaporated fuel, FIG. 8 is a map showing the relationship between the fuel temperature and the generated amount of the evaporated fuel, FIG. 9 is a map showing the relationship between the concentration of the evaporated fuel and the generated amount of the evaporated fuel, FIG. 10 is a map showing the relationship between the fuel amount and the geneerated amount of the evaporated fuel, and FIG. 11 is a map showing the relationship between the fuel amount and the judgment value.

In FIG. 1, the flow amount of air from which dust in the atmosphere is removed by an air cleaner 1 is controlled in accordance with the opening degree of an electrically-operated throttle valve (not shown). The throttle valve is provided to a throttle body 3 equipped in an intake passage between the air cleaner 1 and-air chamber 2, and the opening degree thereof (throttle opening degree) is set by an electrically-operated motor. The throttle opening degree is set on the basis of an output signal from a control device 18 (hereinafter referred to as "ECU") mainly constructed by a microcomputer. The intake air the flow amount of which is controlled by the throttle opening flows through the air chamber 2 and an intake manifold 4 to be mixed with fuel (gasoline) injected from an injector (not shown). The injector is disposed so that the tip thereof is projected into the intake manifold 4, and it is provided every cylinder of the engine. Pressure-adjusted fuel is supplied to each injector through a fuel pipe (not shown) intercommunicating with the fuel tank 5. Air-fuel mixture formed in the intake manifold 4 flows into the combustion chamber of the engine by opening the intake valve. The air-fuel mixture is ignited by an ignition plug and combusted to generate the driving force of the engine. The gas after the combustion is discharged from the combustion chamber to an exhaust passage by opening an exhaust valve.

The evaporated fuel (evaporation gas) generated in the fuel tank 5 is discharged through an evaporative emission control system to the air chamber 2 of the intake system. Specifically, the fuel tank 5 intercommunicates with a canister 7 through an evaporated fuel passage 6 provided at the upper portion of the fuel tank 5. The evaporated fuel in the fuel tank 5 is adsorbed by adsorbent such as activated carbon filled in the canister 7. Gas containing no fuel component (particularly, hydrocarbon (HC), etc.) in the canister 7 is passed through a new air introducing passage 8 and cleaned by a drain filter 9, and then it is discharged to the atmosphere. A drain valve 10 (hereinafter referred to as "CCV") which is controlled to be opened/closed by ECU 18 is interposed in the new air introducing passage 8. In the normal control operation of the valve, CCV 10 is set so that the electromagnetic solenoid thereof is turned off and thus the valve is opened (set to an open state). On the other hand, when a leak diagnosis is carried out, the electromagnetic solenoid is turned on in response to a control signal of ECU 18, and CCV 10 is closed (set to a close state).

Furthermore, a pressure control solenoid valve 11 (hereinafter referred to as "PCV") having a mechanical pressure-adjusting mechanism to adjust the inner pressure of the fuel tank 5 is interposed in the evaporated fuel passage 6. Under the normal operation in which the built-in electromagnetic solenoid is turned off, PCV 11 is mechanically opened/closed in accordance with the pressure difference between the inner pressure of the fuel tank 5 and the atmosphere pressure or the pressure difference between the inner pressure of the fuel tank 5 and the inner pressure of the canister 7. Specifically, when the inner pressure of the fuel tank 5 is higher than the atmosphere pressure by a predetermined value, PCV 11 is opened, and the evaporated fuel in the fuel tank 5 flows to the canister 7 (b→a in the evaporated fuel passage in FIG. 1). Accordingly, the pressure state in the fuel tank 5 is adjusted, and increase of the inner pressure of the fuel tank 5 is suppressed. Furthermore, when the inner pressure of the fuel tank 5 is lower than the inner pressure of the canister 7 by a predetermined value, that is, when the pressure in the fuel tank 5 is set to negative pressure, PCV 11 is also opened, and thus gas in the canister 7 flows to the fuel tank 5 (a→b in the evaporated fuel passage 6 of FIG. 1). Accordingly, the pressure state in the fuel tank 5 is adjusted, and reduction of the pressure in the fuel tank 5 is suppressed. The fuel tank 5 can be effectively prevented from being deformed or damaged by the mechanical pressure-adjusting mechanism of PCV 11 as described above. On the other hand, in the leak diagnosis operation, PCV 11 is controlled so that the electromagnetic solenoid is turned on in response to a control signal of ECU 18 and thus PCV 11 is forcedly opened. Under this valve open state, gas flows in one way from the fuel tank 5 to the canister 7 or from the canister 7 to the fuel tank 5 (in FIG. 1, a→b, b→a in the evaporated fuel passage 6) in accordance with the pressure difference between the inner pressure of the fuel tank 5 and the inner pressure of the canister 7.

A chamber 13 is formed in the purge passage 12 intercommunicating between the canister 7 and the air chamber 2 of the intake system, and a purge control solenoid valve 14 (hereinafter referred to as "purge valve" or "CPV" with CPV being an abbreviation of the term "canister purge valve") is interposed at the downstream side of the purge passage 12. The purge valve 14 is a duty solenoid valve whose opening degree is set in accordance with the duty ratio of a control signal output from ECU 18, and when the leak diagnosis is carried out the opening degree is adjusted in accordance with a diagnosis condition. On the other hand, when the normal control is carried out, the opening degree of the purge valve 14 is controlled in accordance with a driving state to adjust the purge amount. The chamber 13 provided at the upstream side of the purge valve 14 is provided to vanish flow noise or pulsating noise occurring by the opening/closing of the purge valve 14.

A pressure sensor 15 for detecting the inner pressure (inner pressure value) of the fuel tank 5 is secured to the upper portion of the fuel tank 5. The pressure sensor 15 is a sensor for detecting as inner pressure the pressure difference between the atmosphere pressure and the inner pressure of the fuel tank 5, and outputs the inner pressure thus detected as an inner pressure value Pte to ECU 18. A tank inner pressure switching solenoid valve 17 (hereinafter referred to as "tank inner pressure valve") which is controlled to be opened/closed by ECU 18 is interposed in an atmosphere introducing passage 16 for introducing the atmosphere to the pressure sensor 15. The valve 17 is provided for the following reason. That is, when the atmosphere pressure is varied in connection with variation in altitude during running, the inner pressure value Pte is varied even when the absolute pressure in the fuel tank 5 is fixed, and this variation is compensated by the valve 17. In the normal operation, the built-in electromagnetic solenoid is turned off, and the tank inner pressure valve 17 is set to the open state, whereby the atmosphere introducing passage 16 is opened to the atmosphere. On the other hand, in the leak diagnosing operation, the electromagnetic solenoid is turned on in response to the control signal from ECU 18, and the tank inner pressure valve 17 is set to the close state. Accordingly, the pressure state of the atmosphere introducing passage 16 between the pressure sensor 15 and the tank inner pressure valve 17 is adjusted to the atmosphere pressure.

ECU 18 carries out operations relating to the fuel injection amount of the injector, the injection timing of the injector, the ignition timing of the ignition plug, the throttle opening degree, etc. according to a control program stored in ROM. ECU 18 outputs the control amounts (control signals) thus calculated through the operations to various kinds of actuators. ECU 18 carries out the leak diagnosis of the evaporative emission control system containing the fuel tank 5 in the evaporative emission control system described above. ECU 18 needs detection signals from the pressure sensor 15 and various sensors 19 to 22 as information needed to carry out the leak diagnosis. A fuel level sensor 19 is secured in the fuel tank 5, and detects the residual level (fuel amount) L of the fuel accumulated in the fuel tank 5. A fuel temperature sensor 20 detects the temperature Tf of the fuel, and a vehicle speed sensor 21 detects the vehicle speed v. An engine rotational number sensor 22 detects the rotational number Ne of the engine.

When functionally viewing respective parts for executing the leak diagnosis as shown in FIG. 2, ECU 18 has a valve controller 24 and a diagnosing unit 25. The valve controller 24 outputs a control signal indicating an open/close state of each valve 10, 11, 17 in accordance with the condition of the leak diagnosis in the diagnosing portion 25. On the basis of these signals, the electromagnetic solenoid is turned on/off, and the open/close state of the corresponding valve 10, 11, 17 is set. Furthermore, the valve controller 24 outputs a control signal to the purge valve 14 to control the purge valve to the opening degree corresponding to the duty ratio of the control signal.

The diagnosing unit 25 hermetically seals the evaporative emission control system containing the fuel tank 5 under negative pressure on the basis of the target inner pressure Pteb by the valve control using the valve controller 24, and measures the pressure variation amount P2 after the hermetic sealing under negative pressure. The diagnosing unit 25 calculates a diagnosis value X on the basis of at least the pressure variation amount P2, and if the diagnosis value X concerned is larger than a judgment value Y, the diagnosing unit 25 judges that some leak occurs in the evaporative emission control system (that is, there is some abnormality). At this time, the diagnosing unit 25 estimates the generated amount of the evaporated fuel in the fuel tank 5 on the basis of various parameters detected when the diagnosis is started, and variably sets the target inner pressure Pteb on the basis of the generated amount of the evaporated fuel thus estimated. Here, the target inner pressure Pteb is set to a higher value as the generated amount of the evaporated fuel is larger. That is, ECU 18 implements respective functions as an evaporated fuel generated amount estimating unit and a target inner pressure setting unit. When some abnormality in the evaporative emission control system is judged by the diagnosing unit 25, ECU 18 notifies the fact to the driver through, for example, an alarm lamp 26 disposed on an instrument panel.

Next, the leak diagnosis according to this embodiment will be described in detail with reference to the flowchart of the main routine of the leak diagnosis shown in FIG. 3. This routine is called every predetermined interval (for example, 10 ms) in the period from the start of the engine till the stop of the engine (that is, one driving cycle), and executed in ECU 18. A leak diagnosis target of this embodiment is the evaporative emission control system containing the fuel tank 5 (the evaporated fuel passage 6, the canister 7, the purge passage 12 through which the purge valve 14 and the canister 7 intercommunicate with each other, etc.).

When this routine is started, in step S101, ECU 18 first checks whether a diagnosis executing flag Fdiag is "0" or not. The diagnosis executing flag Fdiag is initially set to "0", and it is set to "1" when the leak diagnosis is properly completed. Therefore, when the diagnosis executing flag Fdiag is temporarily changed from "0" to "1" at some timing, the processing goes to step S115 according to the judgment of the step S101 insofar as the driving cycle is continued. In this case, ECU 18 executes the normal control of the valve, and then goes out of this main routine as described later. On the other hand, if it is judged in S101 that Fdiag=0, ECU 18 goes to step S102.

In step S102, ECU 18 judges whether a diagnosis executing condition is satisfied. The diagnosis executing condition is a condition for defining a driving condition suitable to carry out the leak diagnosis, and it is a judgment provided to avoid execution of the diagnosis under improper driving state. The following conditions (1) to (3) are provided as the diagnosis executing condition.

(1) A predetermined time or more elapses after the engine is started (for example, 325 sec).

When purge is carried out to introduce negative pressure into the tank just after the engine is started and before the air-fuel ratio feedback control is started, high-concentration evaporated fuel is introduced into the engine and the air-fuel ratio is greatly enriched, so that engine exhaust gas is deteriorated. For such a reason, the execution of the leak diagnosis is not permitted for a predetermined time after the engine is started.

(2) Undulation of fuel in the fuel tank is small.

Under a condition that the fuel in the fuel tank 5 is greatly undulated, the pressure in the fuel tank 5 is greatly varied, and thus an erroneous judgment in the leak diagnosis may occur. Therefore, the undulation of the fuel in the fuel tank 5 is specified by using the fuel level sensor 19. The undulation of the fuel can be estimated from a variation amount $\Delta L$ per unit time of the fuel amount L detected by the fuel level sensor 19. That is, when the variation amount $\Delta L$ is larger than a properly set judgment value, it is judged that the undulation of the fuel is large and thus the execution of the leak diagnosis is not permitted.

(3) The engine rotational number Ne and the vehicle speed v are larger than predetermined values (for example, $Ne \geqq 1500$ rpm, $v \geqq 70$ km/h).

When the vehicle travels at low speed, the travel state is unstable, and thus an erroneous judgment in the leak diagnosis may occur. Therefore, the leak diagnosis is carried out when the vehicle travels at high speed because the travel state thereof is relatively stable.

When the judgment in step S102 is negative, that is, when at least any one of the diagnosis executing conditions (1) to (3) described above is not satisfied, ECU 18 goes to step S115. ECU 18 carries out the normal control on the following normal valve control in step S115, and then goes out of this main routine.

That is, in step S115, ECU 18 sets the control value XCCV for CCV 10 to "0", and turns off the electromagnetic solenoid to thereby open CCV 10. Furthermore, ECU 18 sets the control value XPCV for PCV 11 to "0", and turns off the electromagnetic solenoid, whereby PCV 11 is opened/closed by a mechanical mechanism. Furthermore, ECU 18 sets the control value dprg for CPV 14 to the predetermined duty ratio corresponding to the driving state and carries out duty control on the electromagnetic solenoid to suitably open/close CPV 14 at a predetermined opening degree. Furthermore, ECU 18 sets the control value for the tank inner pressure valve 17 to "0" and turns off the electromagnetic solenoid to close the tank inner pressure valve 17.

On the other hand, if a positive judgment is made in step S102, that is, if all the diagnosis execution conditions of (1) to (3) are satisfied, ECU 18 goes to step S103 to start the leak diagnosis of the evaporative emission control system.

When the diagnosis execution conditions are satisfied and thus the leak diagnosis is started, ECU 18 first opens PCV 11, and closes CCV 10 and CPV 14 in step S103 to hermetically seal the evaporative emission control system. That is, ECU 18 sets the control value XPCV for PCV 11 to "1" and turns on the electromagnetic solenoid to forcedly open PCV 11. Furthermore, ECU 18 sets the control value XCCV for CCV 10 to "1" and turns on the electromagnetic solenoid to close CCV 10. Still furthermore, ECU 18 sets the control value dprg for CPV 14 to "0" and turns off the electromagnetic solenoid to close CPV 14.

In the subsequent step S104, ECU 18 sets the tank inner pressure value Pteini, the fuel temperature Tfini, the evaporated fuel concentration flprgini and the fuel amount L as various kinds of parameters indicating the state of the evaporative emission control system at the start time of the diagnosis. That is, ECU 18 sets, as the tank inner pressure value Pteini at the diagnosis start time, the tank inner pressure value Pte detected by the pressure sensor 15 just after the evaporative emission control system is hermetically sealed. Furthermore, ECU 18 sets, as the fuel temperature Tfini at the diagnosis start time, the fuel temperature Tf detected by the fuel temperature sensor 20 just after the evaporative emission control system is hermetically sealed. Still furthermore, ECU 18 sets, as the evaporated fuel concentration flprgini at the diagnosis start time, the latest evaporated fuel concentration estimated value flprg which is currently estimated. Here, as well known, the evaporated fuel concentration estimated value flprg is estimated from the state (variation state) of an air-fuel ratio feedback correction amount calculated in the purge control of the evaporated fuel or the like, and it is set in the range from "0" to "0.2", for example. ECU 18 sets, as the fuel amount Lini at the diagnosis start time, the fuel amount L detected by the fuel level sensor 19 just after the evaporative emission control system is hermetically sealed.

When the processing goes from the step S104 to the step S105, ECU 18 checks whether a preset set time t1 elapses after the evaporative emission control system is hermetically sealed, and if it is judged that the set time t1 has not yet elapsed, ECU 18 waits with no action.

On the other hand, if it is judged in step S105 that the set time t1 has elapsed, ECU 18 goes to step S106 to estimate the generated amount of the evaporated fuel (evaporated fuel generated amount) in the fuel tank 5.

Here, the variation of the inner pressure Pte after the evaporative emission control system is hermetically sealed is dependent on the generated amount of the evaporated fuel in the fuel tank 5. Therefore, for example, the pressure variation amount P1 until the set time t1 elapses from the time when the evaporative emission control system is hermetically sealed (see FIGS. 5, 6) is measured, and the generated amount of the evaporated fuel amount may be estimated on the basis of the pressure variation amount P1 thus measured. However, the measurement of the pressure variation amount P1 as described above is normally carried out under a relatively unstable pressure state just after the evaporative emission control system is hermetically sealed, and thus it is difficult to estimate the geneerated amount of the evaporated fuel with high precision on the basis of the pressure variation amount P1 in some cases. Therefore, according to this embodiment, ECU 18 estimates the generated amount of the evaporated fuel by using the tank inner pressure Pteini, the fuel temperature Tfini, the evaporated fuel concentration flpregini and the fuel amount L which are relatively stably detectable parameters. Describing more specifically, ECU 18 contains therein a map indicating the relationship between the tank inner pressure Pteini and the evaporated fuel generated amount (see FIG. 7), a map indicating the relationship between the fuel temperature Tfini and the evaporated fuel generated amount (see FIG. 8), a map indicating the relationship between the evaporated fuel concentration flprgini and the evaporated fuel generated amount (see FIG. 9), a map indicating the relationship between the fuel amount L and the evaporated fuel generated amount (see FIG. 10), etc., which are preset by experiments or simulations, and ECU 18 estimates the generated amount of the evaporated fuel by using these maps. For example, ECU 18 determines the generated amount of the evaporated fuel by using the tank inner pressure value Pteini from the map of FIG. 7, and the generated amount of the evaporated fuel thus determined is corrected by each evaporated fuel generated amount achieved from the maps of FIGS. 8 to 10, etc. to thereby estimate a final evaporated fuel generated amount.

In subsequent step S107, ECU 18 variably sets the target inner pressure Pteb by using the evaporated fuel generated amount estimated in step S106. That is, a preset map indicating the relationship between the evaporated fuel generated amount and the target inner pressure Pteb is stored in ECU 18 as shown in FIG. 6, and ECU 18 refers to this map and sets the target inner pressure Pteb to a higher value as the estimated evaporated fuel generated amount is larger. Here, the target inner pressure Pteb can be set to absolute pressure based on the atmosphere pressure, however, it is preferably set to relative pressure based on the tank inner pressure value Pteini at the time when the diagnosis is started. As described above, by setting the target inner pressure Pteb to relative pressure based on the tank inner pressure value Pteini at the diagnosis start time, it is possible to introduce negative pressure based on the pressure which is stably held at the diagnosis start time.

In subsequent step S108, ECU 18 sets the control value dprg for CPV 14 to a predetermined duty ratio to introduce negative pressure into the evaporative emission control system, and carries out duty control on the electromagnetic solenoid to open CPV 14 at a predetermined opening degree.

When ECU 18 goes from the step S108 to the step S109, ECU 18 checks whether the tank inner pressure value Pte reaches the target inner pressure Pteb, and if it is judged that the tank inner pressure value Pte has not yet reached the target inner pressure Pteb, ECU 18 waits with no action.

On the other hand, if it is judged in step S109 that the tank inner pressure value Pte has reached the target inner pressure Pteb, ECU 18 goes to step S110, and it sets the control value dprg for CPV 14 to "0" and turns off the electromagnetic solenoid to close CPV 14 so that the evaporative emission control system is hermetically sealed under negative pressure.

When ECU 18 goes from step S110 to step S111, ECU 18 checks whether the tank inner pressure value Pte after the hermetic sealing under negative pressure reaches a set inner pressure Pteb1, and it waits with no action if it is judged that the tank inner pressure value Pte has not yet reaches the set inner pressure Pteb1. Here, the set inner pressure Pteb1 is set to an inner pressure value sufficient to stabilize the pressure state of the evaporative emission control system which would be unstable due to negative-pressure introduction. For example, it is variable set in accordance with the target inner pressure Pteb set in step S107.

On the other hand, if it is judged in step S111 that the tank inner pressure value Pte reaches the set inner pressure Pteb1 and thus ECU 18 goes to step S112, ECU 18 checks whether a preset set time t2 elapses after the tank inner pressure value Pte reaches the set inner pressure Pteb1.

If it is judged in step S112 that the set time t2 has not yet elapsed, ECU 18 waits with no action.

On the other hand, it is judged in step S112 that the set time t2 has elapsed and thus ECU 18 goes to step S113, ECU 18 measures the pressure variation amount P2 on the basis of the present tank inner pressure value Pte and the set inner pressure Pteb1. That is, the difference pressure between the present tank inner pressure value Pte and the set inner pressure Pteb1 is measured as the pressure variation amount P2 after the hermetic sealing under negative pressure.

When ECU 18 goes from step S113 to step S114, ECU 18 sets the diagnosis value X on the basis of at least the pressure variation amount P2 measured in step S113, and also sets the judgment value Y corresponding to the fuel amount L by referring to the map shown in FIG. 11, for example. Then, ECU 18 carries out the leak diagnosis based on the comparison between the diagnosis value X and the judgment value Y, and then goes out of the routine. That is, when the diagnosis value X is larger than the judgment value Y, ECU 18 judges that leak occurs in the evaporative emission control system. On the other hand, when the diagnosis value X is smaller than the judgment value Y, ECU 18 judges that no leak occurs in the evaporative emission control system. When the diagnosis in step S114 is executed, Fdiag is set to "1".

According to the above embodiment, the evaporated fuel generated amount at the diagnosis start time is estimated. When the evaporated fuel generated amount thus estimated is large, the target inner pressure Pteb is set to a high value (that is, set to a shallow negative pressure state). On the other hand, the evaporated fuel generated amount thus estimated is small, the target inner pressure Pteb is set to a low value (that is, set to a deep negative pressure), whereby the negative pressure introducing time needed to make the inner pressure of the evaporative emission control system reach the target inner pressure Pteb can be shortened. Accordingly, when the evaporated fuel generated amount is large, the pressure state of the evaporative emission control system can be also suppressed from being unstable due to the introduction of negative pressure, and the pressure variation amount P2 after the hermetic sealing under negative pressure can be measured with high precision, so that the proper leak diagnosis can be carried out.

Furthermore, the map between the evaporated fuel generated amount and the target inner pressure Pteb, etc. can be properly set on the basis of experiments, simulations or the like, and the target inner pressure Pteb is variably set to a proper value. Accordingly, as shown in FIGS. 4 and 5, the behavior of the pressure variation after the hermetic sealing under negative pressure can be set substantially uniform for the equal fuel amount L in the fuel tank 5 without depending on the evaporated fuel generated amount at the diagnosis start time. Accordingly, the judgment value Y for the pressure variation amount P2 (diagnosis value X) can be set to a variable value based on only the fuel amount L, and the leak diagnosis can be simplified. In FIGS. 4 and 5, the behavior of the inner pressure value Pte after the hermetic sealing under negative pressure when no leak occurs in the evaporative emission control system is represented by a solid line, and the behavior when leak occurs is represented by a one-dotted chain line.

In the above-described embodiment, the evaporated fuel generated amount determined on the basis of the tank inner pressure value Pteini is corrected by the evaporated fuel generated amount determined on the basis of the fuel temperature Tfini, the evaporated fuel concentration flprgini, the fuel amount L, etc. to estimate the final evaporated fuel generated amount. However, the present invention is not limited to this embodiment, and for example, the evaporated fuel generated amount determined on the basis of the fuel temperature Tfini, the evaporated fuel concentration flprgini or the fuel amount L may be corrected by the evaporated fuel generated amount determined on the basis of other parameters to estimate a final evaporated fuel generated amount. Furthermore, the evaporated fuel generated amount may be estimated by using at least one of the tank inner pressure value Pteini, the fuel temperature Tfini, the evaporated fuel concentration flprgini and the fuel amount L.

What is claimed is:

1. A diagnostic apparatus for evaporative emission control system having a fuel tank hermetically sealed under negative pressure on the basis of target inner pressure, for judging leak of the evaporated fuel when a diagnosis value, based on a pressure variation amount after the hermetical sealing under at least negative pressure, is larger than a judgment value, said diagnostic apparatus comprising:

an evaporated fuel generated amount estimating unit for estimating a generated amount of evaporated fuel in the fuel tank; and a target inner pressure setting unit for variably setting the target inner pressure on the basis of at least the generated amount of the evaporated fuel estimated by the evaporated fuel generated amount estimating unit, wherein the target inner pressure setting unit sets the target inner pressure to a higher value as the generated amount of the evaporated fuel is larger.

2. The diagnostic apparatus for evaporative emission control system according to claim 1, wherein the target inner pressure setting unit sets the target inner pressure to relative pressure based on fuel tank inner pressure value at the start time of the diagnosis.

3. The diagnostic apparatus for evaporative emission control system according to claim 1, wherein the evaporated fuel generated amount estimating unit estimates a generated amount of evaporated fuel on the basis of at least the fuel tank inner pressure at the diagnosis start time.

4. The diagnostic apparatus for evaporative emission control system according to claim 1, wherein the evaporated fuel generated amount estimating unit estimates a generated amount of evaporated fuel on the basis of at least the fuel temperature at the diagnosis start time.

5. The diagnostic apparatus for evaporative emission control system according to claim 1, wherein the evaporated fuel generated amount estimating unit estimates a generated amount of evaporated fuel on the basis of at least the evaporated fuel concentration estimated when purge control of evaporated fuel is carried out.

6. The diagnostic apparatus for evaporative emission control system according to claim 1, wherein the evaporated fuel generated amount estimating unit estimates a generated amount of evaporated fuel on the basis of at least the fuel amount at the diagnosis start time.

7. A diagnostic apparatus for evaporative emission control system having a fuel tank hermetically sealed at a target inner pressure, for judging leakage of the evaporated fuel based on whether a pressure variation after hermetical sealing is larger than a predetermined value, said diagnostic apparatus comprising:

an evaporated fuel generated amount estimating unit for estimating a generated amount of evaporated fuel in the fuel tank; and a target inner pressure setting unit for setting the target inner pressure, wherein the target inner pressure setting unit sets the target inner pressure based on the generated amount of evaporated fuel estimated by the evaporated fuel generated amount estimating unit.

8. The diagnostic apparatus for evaporative emission control system according to claim 7, wherein, when the estimated generated amount of evaporated fuel is found to be a larger amount than a predetermined level, the target inner pressure is set to a high value.

9. The diagnostic apparatus for evaporative emission control system according to claim 8, wherein setting the target inner pressure to a high value involves setting the target inner pressure to a shallower negative pressure state utilized than a deeper negative pressure state for a low value of the estimated amount of evaporated fuel.

10. The diagnostic apparatus for evaporative emission control system according to claim 7, wherein, when the estimated generated amount of evaporated fuel is deemed as a low amount relative to a predetermined level, the target inner pressure is set at a low value.

11. The diagnostic apparatus for evaporative emission control system according to claim 7, wherein the target inner pressure setting unit sets the target inner pressure to relative pressure based on fuel tank inner pressure value at the start time of the diagnosis.

12. The diagnostic apparatus for evaporative emission control system according to claim 7, wherein the evaporated fuel generated amount estimating unit estimates a generated amount of evaporated fuel on the basis of at least the fuel tank inner pressure at the diagnosis start time.

13. The diagnostic apparatus for evaporative emission control system according to claim 7, wherein the evaporated fuel generated amount estimating unit estimates a generated amount of evaporated fuel on the basis of at least the fuel temperature at the diagnosis start time.

14. The diagnostic apparatus for evaporative emission control system according to claim 7, wherein the evaporated fuel generated amount estimating unit estimates a generated amount of evaporated fuel on the basis of at least the evaporated fuel concentration estimated when purge control of evaporated fuel is carried out.

15. The diagnostic apparatus for evaporative emission control system according to claim 7, wherein the evaporated fuel generated amount estimating unit estimates a generated amount of evaporated fuel on the basis of at least the fuel amount at the diagnosis start time.

16. The diagnostic apparatus for evaporative emission control system according to claim 1, wherein, when the estimated generated amount of evaporated fuel is deemed to be low relative to a predetermined level, the target inner pressure used in diagnosis is at a low value.

17. The diagnostic apparatus for evaporative emission control system according to claim 16, wherein setting the target inner pressure to a high value involves a shallower negative pressure state than a deeper negative pressure state for the low value target inner pressure state.

18. The diagnostic apparatus for evaporative emission control system according to claim 1, further comprising means for measuring a pressure variation amount based on a difference between a present tank pressure value and a set inner pressure and determining if leakage exists based on the pressure variation amount.

19. The diagnostic apparatus for evaporative emission control system according to claim 7, further comprising means for measuring a pressure variation amount based on a difference between a present tank pressure value and a set inner pressure and determining if leakage exists based on the pressure variation amount.

20. The diagnostic apparatus for evaporative emission control system according to claim 2, wherein the evaporated fuel generated amount estimating unit estimates a generated amount of evaporated fuel on the basis of at least the fuel tank inner pressure at the diagnosis start time.

* * * * *